US006092995A

United States Patent [19]

Morikawa

[11] Patent Number: 6,092,995

[45] Date of Patent: Jul. 25, 2000

[54] HIGH PRECISION PUMP FOR MEDICAL AND CHEMICAL ANALYZERS

[75] Inventor: Hideyuki Morikawa, Tokyo, Japan

[73] Assignee: UniFlows Co., Ltd., Tokyo, Japan

[21] Appl. No.: 09/224,609

[22] Filed: Dec. 31, 1998

[51] Int. Cl.[7] ..... F04B 49/00

[52] U.S. Cl. ..... 417/63; 417/515

[58] Field of Search ..... 417/63, 415, 505, 417/518; 74/25

[56] References Cited

U.S. PATENT DOCUMENTS

| | | | |
|---|---|---|---|
| 5,253,981 | 10/1993 | Yang et al. | 417/3 |
| 5,432,098 | 7/1995 | Wilks . | |
| 5,460,055 | 10/1995 | Parker | 73/863.73 |
| 5,807,523 | 9/1998 | Watts et al. | 422/64 |
| 5,820,824 | 10/1998 | Tanaka | 422/100 |
| 5,915,524 | 6/1999 | Tisone . | |

*Primary Examiner*—Teresa Walberg
*Assistant Examiner*—Vinod Patel
*Attorney, Agent, or Firm*—Larry D. Johnson

[57] ABSTRACT

A high accuracy and high precision pump for fluids, specifically for use in chemical and/or medical analyzers includes a female-thread or nut inside the motor rotor shaft and a male-thread or lead screw mated with the female-thread or nut supported by a bearing that restricts the rotation of the lead screw. The lead screw slides axially, and is connected directly to a plunger or piston which is moved forward or backward by the rotation of the motor rotor. The end of the plunger or piston cylinder chamber includes a common fluid path switch-over valve by which fluid flow may be switched over to a plurality of fluid paths. Movement of pumping components, including pump(s), nozzle(s), valve(s), and tubing, is unified to eliminate volume changes due to changes in fluid tubing flexion.

6 Claims, 3 Drawing Sheets

HIGH PRECISION PUMP FOR MEDICAL AND CHEMICAL ANALYZERS

BACKGROUND OF THE INVENTION

1. Field of the Invention

The present invention relates to a high precision fluid pump, specifically for use in chemical and/or medical analyzers.

2. Description of the Prior Art

Chemical and/or medical analyzers employ various kinds of pumps to meter out and dispense fluid samples and/or reagents. In view of the increasing cost of reagents and the increasing demand for smaller amounts of reagents in order to reduce waste and consequent environmental impacts, a small high precision pump is desired. Conventional pumps currently used in medical and chemical analyzers fail to achieve the desired precision.

SUMMARY OF THE INVENTION

The high precision pump for medical and chemical analyzers provides a high accuracy pump for fluids, specifically for use in chemical and/or medical analyzers, and preferably includes a female-thread or nut inside the motor rotor shaft and a male-thread or lead screw mated with the female-thread or nut supported by a bearing that restricts the rotation of the lead screw. The lead screw slides axially, and is connected directly to a plunger or piston which is moved forward or backward by the rotation of the motor rotor. The end of the plunger or piston cylinder chamber includes a common fluid path switch-over valve by which fluid flow may be switched over to a plurality of fluid paths. Movement of pumping components, including pump(s), nozzle(s), valve(s), and tubing, is unified to eliminate volume changes due to changes in fluid tubing flexion.

The invention thus provides an improved pump combined with valve(s) which unifies the movement of the tubing with that of the pump(s), nozzle(s) and valve(s), rather than isolating movement at the tubing between the fluid flow switch-over valve and the suction and discharge nozzles of the sample. This minimizes the fluid volume between the valve and pump, resulting in a miniaturized pump with built-in valve(s). The invention is mechanically simple, inexpensive to manufacture, efficient and cost-effective in operation due to the ease of replacing fluids, and therefore minimizes both the waste of expensive reagents and adverse environmental impact.

A typical prior art conventional pump with valve generally has dimensions of 65 mm (2.6") width, 142 mm (5.6") depth, and 254 mm (10") height, totaling 2,344.4 cubic centimeters; it generally has a weight of approximately 2,000 grams (4.41 lbs.). The pump combined with valve(s) of the present invention may have maximum dimensions of only 42 mm (1.66") width, 43 mm (1.67") depth, and 150 mm (6.0") height, totaling 270.9 cubic centimeters; and have a maximum weight of 420 grams (0.93 lbs.). Thus, the chemical and/or medical analyzer pump based on this invention may be approximately 89 percent smaller and 79 percent lighter than a conventional medical or chemical analyzer pump.

DETAILED DESCRIPTION OF A PREFERRED EMBODIMENT

Figure 1:
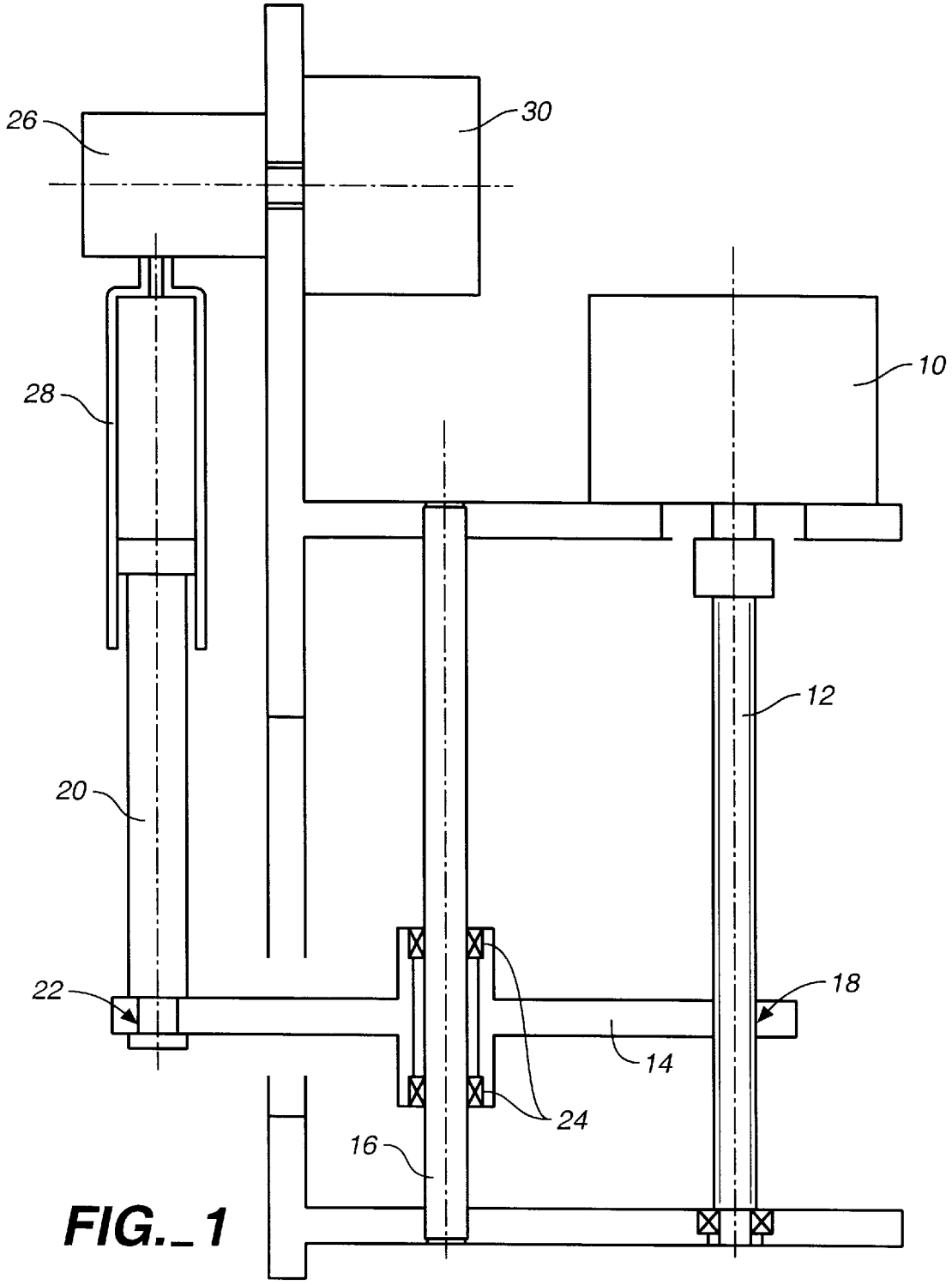
FIG. 1 is a side elevation of a conventional (prior art) pump used in chemical and/or medical analyzers.

FIG. 1 (Prior Art) illustrates a conventional pump used in chemical and/or medical analyzers. The rotation of the pump drive motor 10 is transmitted to the lead screw 12. The reciprocation of the slider 14 is controlled by the slide shaft 16. The slider 14 is mated with the threaded lead screw 12 at the nut 18 and moves up and down by the rotation of the pump drive motor 10. The slider 14 is connected to the pump piston 20 by means of the piston holder 22, and its travel along the slide shaft 16 is facilitated by bearings 24. As the pump piston 20 moves up and down, fluid sample or reagent (not shown) in the fluid flow switch-over valve 26 is sucked into or discharged from the pump cylinder 28. The switch-over of the fluid connected with the fluid flow switch-over valve 26 is made by the switch-over valve motor 30.

Because the pump piston 20 is not driven directly by the pump drive motor 10, the clearance in connecting parts, the bending of parts, and the expansion and contraction of the parts from temperature changes and other factors make pumping precision difficult to achieve and maintain. Furthermore, a conventional pump is too large for automated chemical and/or medical analyzers and too heavy when installed on the manipulator.

Figure 2:
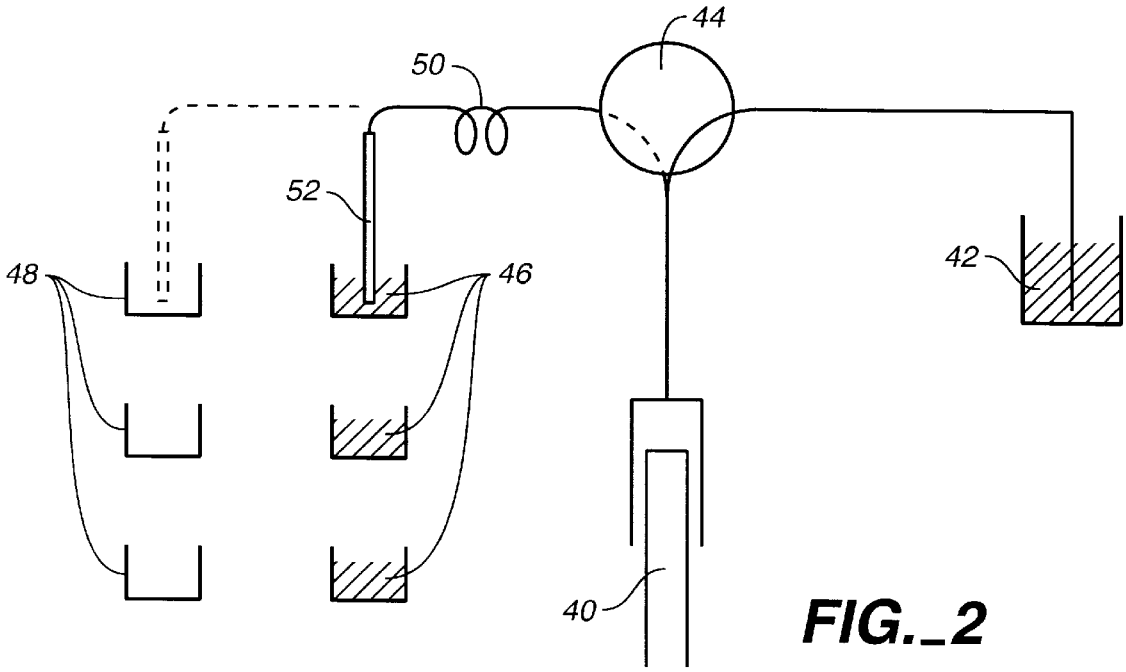
FIG. 2 is a schematic diagram of the fluid paths of a conventional (prior art) pump used in chemical and/or medical analyzers.

FIG. 2 (Prior Art) depicts typically currently existing analyzer fluid paths. Such paths are generally designed and constructed such that the pump 40 is connected with the fluid reagents 42 through the fluid flow switch-over valve 44. When a specified volume of reagent 42 is drawn into the pump 40, the fluid flow switch-over valve 44 is switched over to connect the pump 40 with sample 46. Then, after a specified volume of sample 46 is drawn in, the metered sample 46 and reagent 42 are discharged into the reaction measurement reservoir 48.

Typically, a plurality of sample and reaction measurement reservoirs are used, and reagent is frequently replenished. Conventional pumps with complex mechanisms must be solidly installed in the analyzer, and the tubing 50 between the fluid flow switch-over valve 44 and the sample suction/discharge nozzles 52 is roved and variously flexed during operation. Such changes in the tubing bend cause a change in volume within the tubing, resulting in a deterioration of metering accuracy and precision. The magnitude of the change in the volume caused by the change in the tubing bend is evidenced in a pulse damper in liquid chromatography to eliminate the pulsation in the fluid flow.

The tubing between the fluid flow switch-over valve 44 and the pump 40, being by far longer than the tubing used in the pump of the present invention, create a large amount of waste in replacement of reagent. This must be eliminated to reduce cost and minimize environmental pollution.

Figure 3:
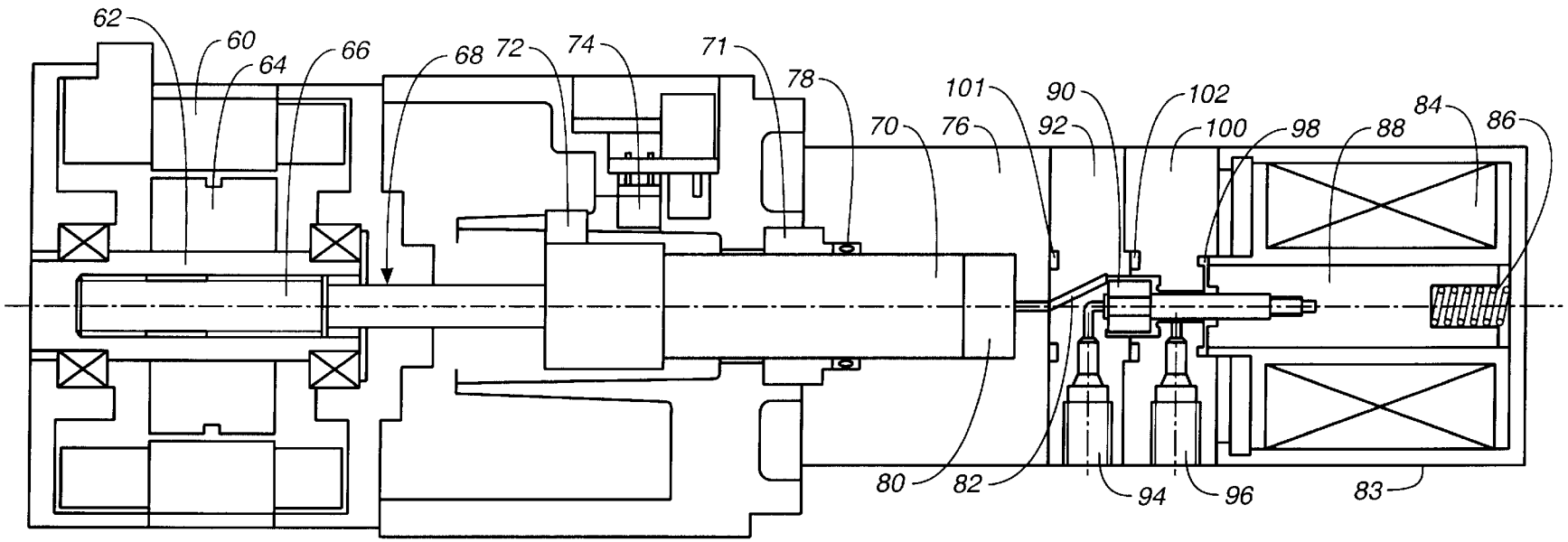
FIG. 3 is a cross-sectional view of the present invention.

FIG. 3 is a cross-sectional view of the inventive high precision pump for chemical and/or medical analyzers. The principal characteristic of the present invention is the unified movement of all pump(s), nozzle(s), tubing and valve(s), substantially reducing pump size, weight and complexity, and substantially increasing pump accuracy and precision.

When the stepping motor coils 60 are actuated, the internally threaded rotor shaft 62, which is solidly connected to the stepping motor rotor 64, starts to rotate in a first (e.g., clockwise) direction. The lead screw 66, mated with the rotor shaft 62, is supported by the sliding bearing 68 so that the rotation of the lead screw 66 is controlled and it slides axially, and the plunger or piston 70, solidly connected to the lead screw 66, moves in a discharge direction (rightward in this figure). The shutter 72 connected to the plunger 70 also moves in a discharge direction. A mechanical or electronic sensor 74 detects the location of the plunger 70 when the discharge is completed, and this stops the motor from rotating in a clockwise direction. This stopping point is the benchmark or zero point of the plunger 70.

The pump head 76 and the plunger 70 are sealed by the plunger seal 78, and together define the cylinder chamber 80. The cylinder chamber 80 is connected with the common fluid path 82 of the fluid path switch-over valve 83.

When the electrical supply to the solenoid coils 84 of the fluid path switch-over valve (solenoid valve) 83 is turned off, the compression spring 86 pushes the valve plunger 88 in a fluid intake direction (leftward in this figure), and the disk 90 is pushed against the first (discharge) valve body 92, shutting off the common fluid path 82 from the first (discharge) valve fluid path 94. When the common fluid path 82 is connected to the second (intake) valve fluid path 96, it is sealed off from the outside by means of a diaphragm 98 adjacent second (intake) valve body 100. O-rings 101, 102 are used to seal first valve body 92 and second valve body 100.

When the stepping motor coils 60 are actuated in a reverse polarity under the foregoing conditions, the stepping motor rotor 64 and the rotor shaft 62 rotate in a second (e.g., counter-clockwise) direction; the plunger 70 moves in an intake direction (left-ward), and the fluid flow connected with the second (intake) valve fluid path 96 enters the cylinder chamber 80. When the electrical supply to the solenoid coils 84 is turned on, the plunger 88 overcomes the compression spring 86 and is pulled right-ward, and the disk 90 is pushed against the valve seat of the second (intake) valve body 100, shutting off the common fluid path 82 from communication with the second (intake) valve fluid path 96, and connecting the common fluid path 82 with the first (discharge) valve fluid path 94.

When the stepping motor coils 60 are then actuated again in the first polarity, the stepping motor rotor 64 and the rotor shaft 62 again rotate in a clockwise direction, the plunger 70 moves rightward, and the fluid in the cylinder chamber 80 is discharged through the first (discharge) valve fluid path 94. The suction and discharge volume of the fluid, i.e., the stroke volume of the plunger 70, is controlled by the number of pulses transmitted to the stepping motor coils 60.

The invention thus provides an apparatus for pumping precise amounts of sample or reagent in a chemical and/or medical analyzer, and includes electrically actuated stepping motor coils; a stepping motor rotor; an internally threaded rotor shaft solidly connected to the stepping motor rotor; a lead screw mated with the internally threaded rotor shaft; a sliding bearing which supports the lead screw and controls the rotation of the lead screw such that the lead screw slides axially; a cylinder chamber for the intake and discharge of fluids; means for drawing fluids into and discharging fluids from the cylinder chamber; means for solidly connecting the lead screw to the means for drawing fluids into and discharging fluids from the cylinder chamber; a sensor for registering when the discharge of fluids from the cylinder chamber is completed; a fluid path for delivering fluids between the exterior of the apparatus and the cylinder chamber; and a fluid flow switch-over valve connected to the fluid path, preferably controlled by a solenoid valve. The means for drawing fluids into and discharging fluids from the cylinder chamber may include a plunger or piston positioned such that its radius is perpendicular to the longitudinal axis of the interior wall of the cylinder chamber, and means for securing the plunger to the lead screw; or a piston positioned such that the radius of its head is perpendicular to the longitudinal axis of the interior wall of the cylinder chamber, and means for securing the piston to the lead screw. The sensor may be an electronic or mechanical sensor. The fluid path for delivering fluids between the exterior of the apparatus and the cylinder chamber may consist of flexible plastic tubing, or rigid, non-flexible tubing.

By having a solenoid valve built into the miniaturized pump, dead volume or internal chamber volume is minimized. This is paramount not only to obtain high precision and accuracy, but to minimize the waste of expensive reagents resulting in an environmentally-friendly micro-pump. Fluid replacement and replenishment can be easily performed, as the solenoid valve is an integral part of the pump. Tubing can be simply connected with selectable tubing joint locations, for example, inlets and outlets which are selectable at the plurality of ports on the pump head circumference. The pump can be effectively mounted on the manipulator of automated analyzers, and is not only small in dimension, but light in weight. As the pump is moved or transferred, all the components such as nozzles, solenoid valves and tubing are moved or transferred automatically, as these components are integral with the pump. This avoids possible volumetric changes caused by flexion, twists and convolution of the fluid tubing.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What claimed as invention is:

1. An apparatus for pumping precise amounts of sample or reagent in a chemical or medical analyzer, said apparatus comprising:

an electrically actuated stepping motor coil and a stepping motor rotor, by which the rotor may be rotated in either a clockwise or counterclockwise direction;

a threaded rotor shaft solidly connected to said stepping motor rotor, and which rotates synchronously and in the same direction as said stepping motor rotor;

a lead screw mated with said threaded rotor shaft;

a sliding bearing which supports the lead screw and controls the rotation of said lead screw such that said lead screw slides axially;

a cylinder chamber for the intake and discharge of fluids;

plunger means for drawing fluids into and discharging fluids from said cylinder chamber;

means for connecting said lead screw to said plunger means;

a sensor for registering a position of said plunger means;

a fluid path for delivering fluids between the exterior of said apparatus and said cylinder chamber; and a fluid flow switch-over valve connected to said fluid path.

2. The apparatus of claim 1 wherein said fluid flow switch-over valve comprises a solenoid valve.

3. The apparatus as recited in claim 1, wherein said sensor is an electronic sensor.

4. The apparatus as recited in claim 1, wherein said sensor is a mechanical sensor.

5. The apparatus as recited in claim 1, wherein said fluid path for delivering fluids between the exterior of said apparatus and said cylinder chamber comprises flexible plastic tubing.

6. The apparatus as recited in claim 1, wherein said fluid path for delivering fluids between the exterior of said apparatus and said cylinder chamber comprises rigid, non-flexible tubing.

* * * * *